US010133228B2

(12) United States Patent
Kohama

(10) Patent No.: US 10,133,228 B2
(45) Date of Patent: Nov. 20, 2018

(54) PAPER FEED DEVICE AND IMAGE FORMING APPARATUS

(71) Applicant: KYOCERA Document Solutions Inc., Osaka (JP)

(72) Inventor: Atsushi Kohama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 398 days.

(21) Appl. No.: 14/815,247

(22) Filed: Jul. 31, 2015

(65) Prior Publication Data

US 2016/0031665 A1 Feb. 4, 2016

(30) Foreign Application Priority Data

Jul. 31, 2014 (JP) ..... 2014-156534

(51) Int. Cl.
*G03G 15/00* (2006.01)

(52) U.S. Cl.
CPC ..... *G03G 15/6529* (2013.01); *G03G 15/6508* (2013.01); *G03G 2215/00599* (2013.01); *G03G 2215/00603* (2013.01)

(58) Field of Classification Search
CPC ..... B65H 1/28; B65H 2405/33; B65H 2405/331; B65H 2405/332; B65H 2405/36; B65H 3/446; B65H 5/26; G03G 15/6529; G03G 15/6508
USPC ..... 271/9.01, 9.04
See application file for complete search history.

(56) References Cited

U.S. PATENT DOCUMENTS 4,484,734 A * 11/1984 Tsudaka ..... G03G 15/6502 271/114
7,397,576 B2 * 7/2008 Hong ..... B65H 3/44 358/1.15
9,291,976 B2 * 3/2016 Hashii ..... G03G 15/6529
2003/0048474 A1 * 3/2003 Hong ..... B65H 3/44 358/1.15
2010/0020354 A1 * 1/2010 Ito ..... G03G 15/5004 358/1.15

FOREIGN PATENT DOCUMENTS

JP 2002-255382 A 9/2002

* cited by examiner

*Primary Examiner* — Thomas A Morrison
(74) *Attorney, Agent, or Firm* — Studebaker & Brackett PC

(57) ABSTRACT

A paper feed device includes a plurality of paper feed sections and a selection control section. Selection periods include a specific selection period during which at least two selection signals among a plurality of selection signals are not at a normal level. Non-selection periods include a first normal period, a second normal period, a preceding non-selection period, and a succeeding non-selection period. The preceding non-selection period is between the first normal period and the specific selection period. A specific selection signal among the at least two selection signals is switched from the normal level to a selection level during the preceding non-selection period. The succeeding non-selection period is between the specific selection period and the second normal period. The specific selection signal is switched from the selection level to the normal level during the succeeding non-selection period.

7 Claims, 8 Drawing Sheets

| Selection control section output (SEL0,SEL1,SEL2) | 111 | 110 | 101 | 100 | 011 | 010 | 001 | 000 |
|---|---|---|---|---|---|---|---|---|
| Paper feed section selection logic | Third stage selection | Second stage selection | Non-selection | First stage selection | Non-selection | Non-selection | Non-selection | Non-selection |
| First stage paper feed section CPU (SEL0a,SEL1a,SEL2a) | 111 | 110 | 101 | 100 | 011 | 010 | 001 | 000 |
| Second stage paper feed section CPU (SEL0b,SEL1b,SEL2b) | | 100 | 010 | 000 | 111 | 101 | 010 | 001 |
| Third stage paper feed section CPU (SEL0c,SEL1c,SEL2c) | 100 | 000 | 101 | 001 | 110 | 010 | 101 | 011 |

FIG. 6

PAPER FEED DEVICE AND IMAGE FORMING APPARATUS

INCORPORATION BY REFERENCE

The present application claims priority under 35 U.S.C. § 119 to Japanese Patent Application No. 2014-156534, filed Jul. 31, 2014. The contents of this application are incorporated herein by reference in their entirety.

BACKGROUND

The present disclosure relates to paper feed devices and image forming apparatuses.

An image forming apparatus includes paper feed sections. The paper feed sections for example have paper of different sizes preloaded therein. In one example of an image forming apparatus (recording apparatus), a drive signal is supplied to a paper feed section (option cassette) selected by a selection signal and paper is supplied from the selected paper feed section.

SUMMARY

A paper feed device according to the present disclosure includes a plurality of paper feed sections and a selection control section. The plurality of paper feed sections each include a paper feed control section. The selection control section outputs a plurality of selection signals to each of the plurality of paper feed sections for selecting a paper feed section from among the plurality of paper feed sections. Each of the paper feed control sections commences communication with the selection control section based on the plurality of selection signals. Each of the plurality of selection signals is switchable between a normal level and a selection level. The plurality of selection signals are set such as to select a paper feed section from among the plurality of paper feed sections during selection periods and to not select any of the paper feed sections during non-selection periods. The selection periods include a specific selection period during which at least two selection signals among the plurality of selection signals are at the selection level. The non-selection periods include a first normal period, a second normal period, a preceding non-selection period, and a succeeding non-selection period. The plurality of selection signals are each at the normal level during the first normal period. The plurality of selection signals are each at the normal level during the second normal period. The preceding non-selection period is between the first normal period and the specific selection period. A specific selection signal among the at least two selection signals is switched from the normal level to the selection level during the preceding non-selection period. The succeeding non-selection period is between the specific selection period and the second normal period. The specific selection signal is switched from the selection level to the normal level during the succeeding non-selection period.

An image forming apparatus according to the present disclosure includes the paper feed device described above and an image forming section. The image forming section forms an image on paper fed from the paper feed device.

BRIEF DESCRIPTION OF THE DRAWINGS

FIG. 6 is a table illustrating selection logic of the paper feed device according to the third embodiment of the present disclosure.

DETAILED DESCRIPTION

Figure 1:
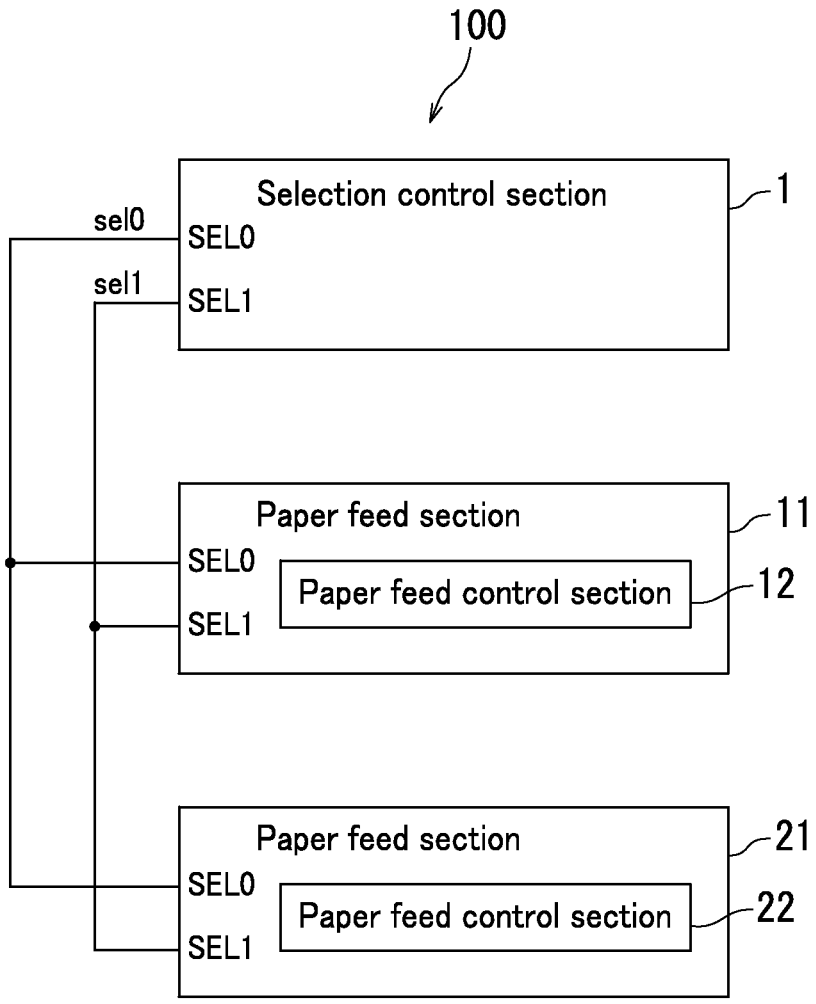
FIG. 1 is a block diagram of a paper feed device according to a first embodiment of the present disclosure.

The following explains embodiments of the present disclosure with reference to the drawings. Elements that are the same or equivalent are indicated in the drawings using the same reference signs and repeated description thereof is omitted.

[First Embodiment]

Figure 2:
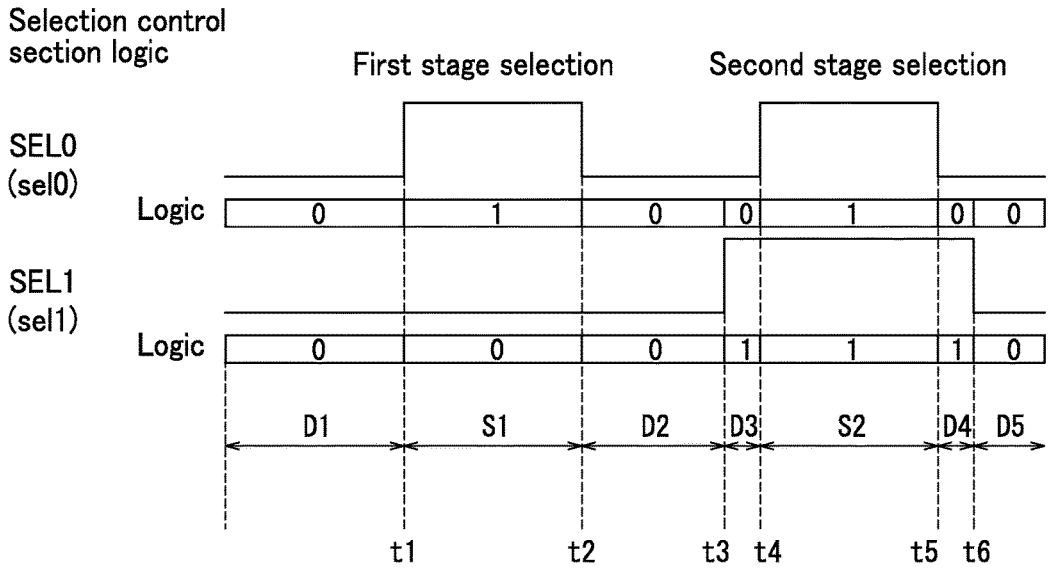
FIG. 2 is a time chart for the paper feed device according to the first embodiment of the present disclosure.

The following explains a paper feed device 100 according to a first embodiment of the present disclosure with reference to FIGS. 1 and 2. FIG. 1 is a block diagram of the paper feed device 100 according to the first embodiment of the present disclosure. FIG. 2 is a time chart for the paper feed device 100 according to the first embodiment of the present disclosure.

The paper feed device 100 includes paper feed sections 11 and 21, and a selection control section 1. The paper feed device 100 is for example installed in an image forming apparatus. The paper feed device 100 feeds sheets of paper that are stored in the paper feed sections 11 and 21.

The paper feed section 11 includes a paper feed control section 12. The paper feed section 21 includes a paper feed control section 22. In the present embodiment the paper feed sections are present as two stages, with the paper feed section 11 corresponding to a first stage and the paper feed section 21 corresponding to a second stage. The paper feed control sections 12 and 22 control paper feeding operation. For example, when the paper feed control section 12 or 22 is selected by the selection control section 1, the paper feed control section 12 or 22 performs paper feeding by causing rotation of a roller.

The selection control section 1 outputs selection signals sel0 and sel1 for selecting one paper feed section from among the paper feed sections 11 and 21 to feed paper. The selection signal sel0 is input to the paper feed section 11 and the paper feed section 21. The selection signal sel1 is input to the paper feed section 11 and the paper feed section 21.

Each of the paper feed control sections 12 and 22 commences communication with the selection control section 1 based on the selection signals sel0 and sel1. The selection signals sel0 and sel1 are set such as to select one of the paper feed sections 11 and 21 during selection periods and to not select either of the paper feed sections 11 and 21 during non-selection periods. Each of the selection signals is switchable between a normal level and a selection level. In the paper feed device 100 according to the present embodiment, the normal level is LOW (0) and the selection level is HIGH (1) for each of the selection signals (selection signal sel0 and selection signal sel1).

In the paper feed device 100 according to the present embodiment, the paper feed section 11 is activated when the selection signal sel0 is HIGH (1) (selection level) and the selection signal sel1 is LOW (0) (normal level) and, in such a situation, the paper feed control section 12 of the paper feed section 11 commences communication with the selection control section 1, but in other situations the paper feed section 11 is deactivated. Therefore, a period during which the selection signal sel0 is HIGH (1) and the selection signal sel1 is LOW (0) is a selection period.

The paper feed section 21 is activated when the selection signal sel0 and the selection signal sel1 are both HIGH (1) and, in such a situation, the paper feed control section 22 of the paper feed section 21 commences communication with the selection control section 1, but in other situations the paper feed section 21 is deactivated. Therefore, a period during which the selection signal sel0 and the selection signal sel1 are both HIGH (1) is a selection period.

As described above, a period during which the selection signal sel0 is HIGH (1) and the selection signal sel1 is LOW (0) and a period during which the selection signal sel0 and the selection signal sel1 are both HIGH (1) are selection periods in the paper feed device 100, and other periods are non-selection periods.

The following explains a selection operation of the paper feed sections 11 and 21 by the selection control section 1. In the following example, the paper feed section 11 is first selected and then the paper feed section 21 is subsequently selected.

Selection of the paper feed section 11 is explained first. The selection signal sel0 and the selection signal sel1 output from the selection control section 1 are both LOW (normal level) during period D1 until time t1. During period D1, the selection signal sel0 is LOW, the selection signal sel1 is LOW, and neither the paper feed section 11 nor the paper feed section 21 is selected. Therefore, period D1 is a non-selection period.

During period S1 from time t1 to time t2, the selection signal sel1 remains as LOW and the selection signal sel0 is switched from LOW to HIGH, and, as a result, the first stage paper feed section 11 is selected. Therefore, period S1 is a selection period. The paper feed control section 12 of the paper feed section 11 commences communication with the selection control section 1 in period S1.

During period D2 from time t2 to time t3, the selection signal sel1 remains as LOW and the selection signal sel0 is switched from HIGH to LOW. During period D2, neither the paper feed section 11 nor the paper feed section 21 is selected. Therefore, period D2 is a non-selection period. The process described above is used to select the paper feed section 11.

Next, selection of the paper feed section 21 is explained. During period D3 from time t3 to time t4, the selection signal sel0 remains as LOW and the selection signal sel1 is switched from LOW to HIGH. During period D3, neither the paper feed section 11 nor the paper feed section 21 is selected. Therefore, period D3 is a non-selection period.

During period S2 from time t4 to time t5, the selection signal sel1 remains as HIGH and the selection signal sel0 is switched from LOW to HIGH, and, as a result, the second stage paper feed section 21 is selected. Therefore, period S2 is a selection period. The paper feed control section 22 of the paper feed section 21 commences communication with the selection control section 1 in period S2.

During period D4 from time t5 to time t6, the selection signal sel1 remains as HIGH and the selection signal sel0 is switched from HIGH to LOW. During period D4, neither the paper feed section 11 nor the paper feed section 21 is selected. Therefore, period D4 is a non-selection period.

During period D5 after time t6, the selection signal sel0 remains as LOW and the selection signal sel1 is switched from HIGH to LOW. During period D5, neither the paper feed section 11 nor the paper feed section 21 is selected. Therefore, period D5 is a non-selection period.

The following explanation focuses on period S2 during which the paper feed section 21 is selected and periods D3 and D4 that respectively occur before and after period S2. During period D3, the selection signal sel1 is switched to HIGH at time t3, which occurs before time t4 at which the selection signal sel0 is switched to HIGH. During period D3, neither the paper feed section 11 nor the paper feed section 21 is selected.

Next, the selection signal sel0 is switched from LOW to HIGH at time t4. The second stage paper feed section 21 is selected as a result of the selection signal sel0 being HIGH and the selection signal sel1 being HIGH. Also, the paper feed control section 22 of the paper feed section 21 commences communication with the selection control section 1.

At time t5, the selection signal sel0 is switched from HIGH to LOW and, as a result, a transition occurs from a selection period to a non-selection period. After time t5, the selection signal sel1 is switched from HIGH to LOW at time t6. The process described above is used to select the paper feed section 21.

As described above, in a situation in which the selection control section 1 switches both the selection signal sel0 and the selection signal sel1 from LOW (normal level) to HIGH (selection level), the selection control section 1 switches the selection signal sel1 to HIGH while maintaining a non-selection state, before switching the selection signal sel0 to HIGH. As a result, period D3 between period D2 and period S2 is a preceding non-selection period during which the selection signal sel1 is switched from LOW to HIGH. In a situation in which the selection control section 1 switches both the selection signal sel0 and the selection signal sel1 from HIGH (selection level) to LOW (normal level), the selection control section 1 switches the selection signal sel0 to LOW in order to transition to a non-selection state in advance, before switching the selection signal sel1 to LOW. As a result, period D4 between period S2 and period D5 is a succeeding non-selection period during which the selection signal sel1 is switched from HIGH to LOW.

FIG. 2 illustrates an idealized time chart for the selection signals sel0 and sel1, but in reality switching of the selection signals sel0 and sel1 between LOW and HIGH may be delayed. According to the paper feed device 100 of the present embodiment, even if switching of the selection signal sel1 from LOW to HIGH at time t3 is slightly delayed, switching of the selection signal sel1 from LOW to HIGH is still completed before switching of the selection signal sel0 from LOW to HIGH at time t4. Therefore, erroneous selection of the paper feed section 11 during period S2 can be inhibited.

Furthermore, according to the paper feed device 100 of the present embodiment, even if switching of the selection signal sel0 from HIGH to LOW at time t5 is slightly delayed, switching of the selection signal sel0 from HIGH to LOW is still completed before switching of the selection signal sel1 from HIGH to LOW at time t6. Therefore, erroneous selection of the paper feed section 11 during period D4 can be inhibited.

As described above with reference to FIGS. 1 and 2, in a situation in which the selection signal sel0 and the selection signal sel1 are both switched from the normal level to the selection level in the paper feed device 100, the selection signal sel1 is switched from the normal level to the selection level before the selection signal sel0 is switched from the normal level to the selection level, and is switched back from the selection level to the normal level after the selection signal sel0 has been switched from the selection level to the normal level. Therefore, a paper feed section can be appropriately selected even if a deviation in timing occurs due to a delay in propagation of the selection signal sel0 and the selection signal sel1.

[Second Embodiment]

Figure 3:
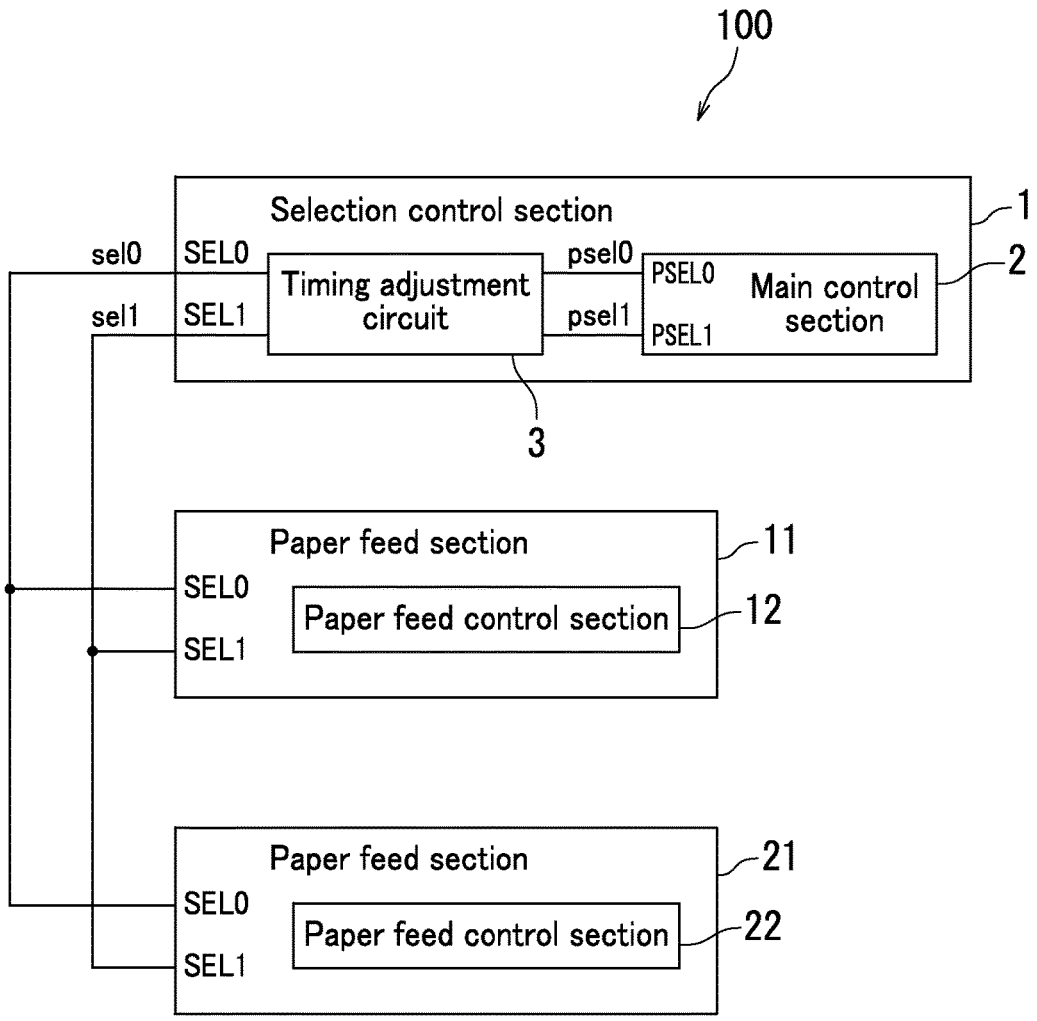
FIG. 3 is a block diagram of a paper feed device according to a second embodiment of the present disclosure.
Figure 4:
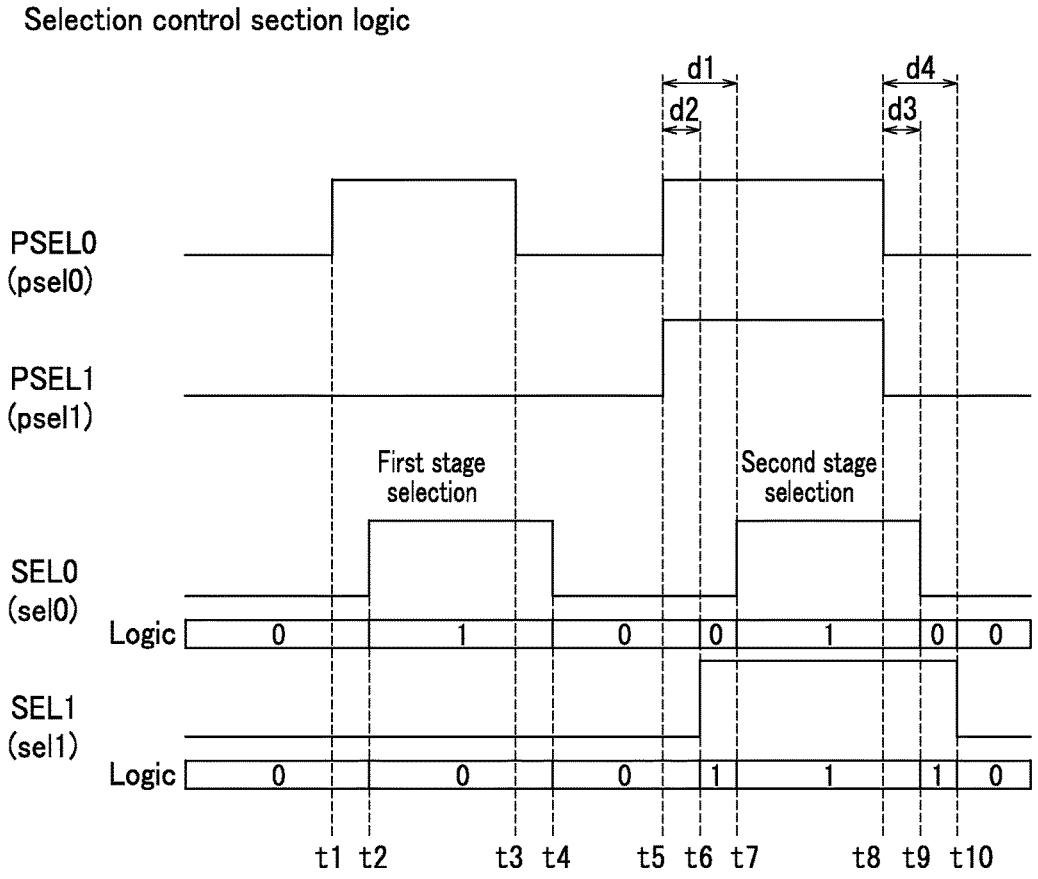
FIG. 4 is a time chart for the paper feed device according to the second embodiment of the present disclosure.

The following explains a paper feed device 100 according to a second embodiment of the present disclosure with reference to FIGS. 3 and 4. FIG. 3 is a block diagram of the paper feed device 100 according to the second embodiment of the present disclosure. FIG. 4 is a time chart for the paper feed device 100 according to the second embodiment of the present disclosure. The paper feed device 100 according to the second embodiment of the present disclosure has the same configuration as the paper feed device 100 according to the first embodiment in all aspects other than that the selection control section 1 includes a main control section 2 and a timing adjustment circuit 3. Therefore, explanation of aspects of configuration that are the same is omitted.

The selection control section 1 includes the main control section 2 and the timing adjustment circuit 3. The main control section 2 outputs selection precursor signals (selection precursor signal psel0 and selection precursor signal psel1).

The timing adjustment circuit 3 generates selection signals based on the selection precursor signals. In the present embodiment, the timing adjustment circuit 3 generates a selection signal sel0 based on the selection precursor signal psel0. The timing adjustment circuit 3 also generates a selection signal sel1 based on the selection precursor signal psel1. More specifically, the timing adjustment circuit 3 generates the selection signal sel0 by delaying the selection precursor signal psel0 by a specific period of time. In addition, the timing adjustment circuit 3 generates the selection signal sel1 by delaying the selection precursor signal psel1 by a specific period of time.

The timing adjustment circuit 3 generates the selection signals from the selection precursor signals by delaying the selection precursor signals by different periods of time relative to one another. More specifically, the selection precursor signal psel0 and the selection precursor signal psel1 are both switched from LOW to HIGH at t5. The timing adjustment circuit 3 delays the selection precursor signal psel1 for a second delay time d2 during a period from time t5 to time t6 and, as a result, the selection signal sel1 is switched from LOW to HIGH at time t6. In addition, the timing adjustment circuit 3 delays the selection precursor signal psel0 for a first delay time d1 during a period from time t5 to time t7 and, as a result, the selection signal sel1 is switched from LOW to HIGH at time t7. The second delay time d2 indicating a delay time of the selection signal sel1 relative to the selection precursor signal psel1 is shorter than the first delay time d1 indicating a delay time of the selection signal sel0 relative to the selection precursor signal psel0. Therefore, the selection signal sel1 is switched to the selection level (HIGH) before the selection signal sel0 is switched to the selection level. In other words, the selection signal sel1 rises before the selection signal sel0.

On the other hand, the selection precursor signal psel0 and the selection precursor signal psel1 are both switched from HIGH to LOW at time t8. The timing adjustment circuit 3 delays the selection precursor signal psel0 for a first delay time d3 during a period from time t8 to time t9 and, as a result, the selection signal sel0 is switched from HIGH to LOW at time t9. In addition, the timing adjustment circuit 3 delays the selection precursor signal psel1 for a second delay time d4 during a period from time t8 to time t10 and, as a result, the selection signal sel1 is switched from HIGH to LOW at time t10. The first delay time d3 indicating a delay time of the selection signal sel0 relative to the selection precursor signal psel0 is shorter than the second delay time d4 indicating a delay time of the selection signal sel1 relative to the selection precursor signal psel1. Therefore, the selection signal sel1 is switched to the normal level (LOW) after the selection signal sel0 has been switched to the normal level. In other words, the selection signal sel1 falls after the selection signal sel0.

As explained above with reference to FIGS. 3 and 4, the timing adjustment circuit 3 in the paper feed device 100 generates the selection signals sel0 and sel1 from selection precursor signals (selection precursor signals psel0 and psel1) by delaying the selection precursor signals psel0 and psel1 by different periods of time relative to one another. Therefore, even when a deviation in timing occurs due to a delay in selection signal propagation, a paper feed section 11 or 21 can be appropriately selected by causing an intentional deviation between times at which selection signals are switched. Although the above description is for a situation in which the paper feed device 100 includes two paper feed sections 11 and 21, the paper feed device 100 may include three or more paper feed sections.

[Third Embodiment]

Figure 5:
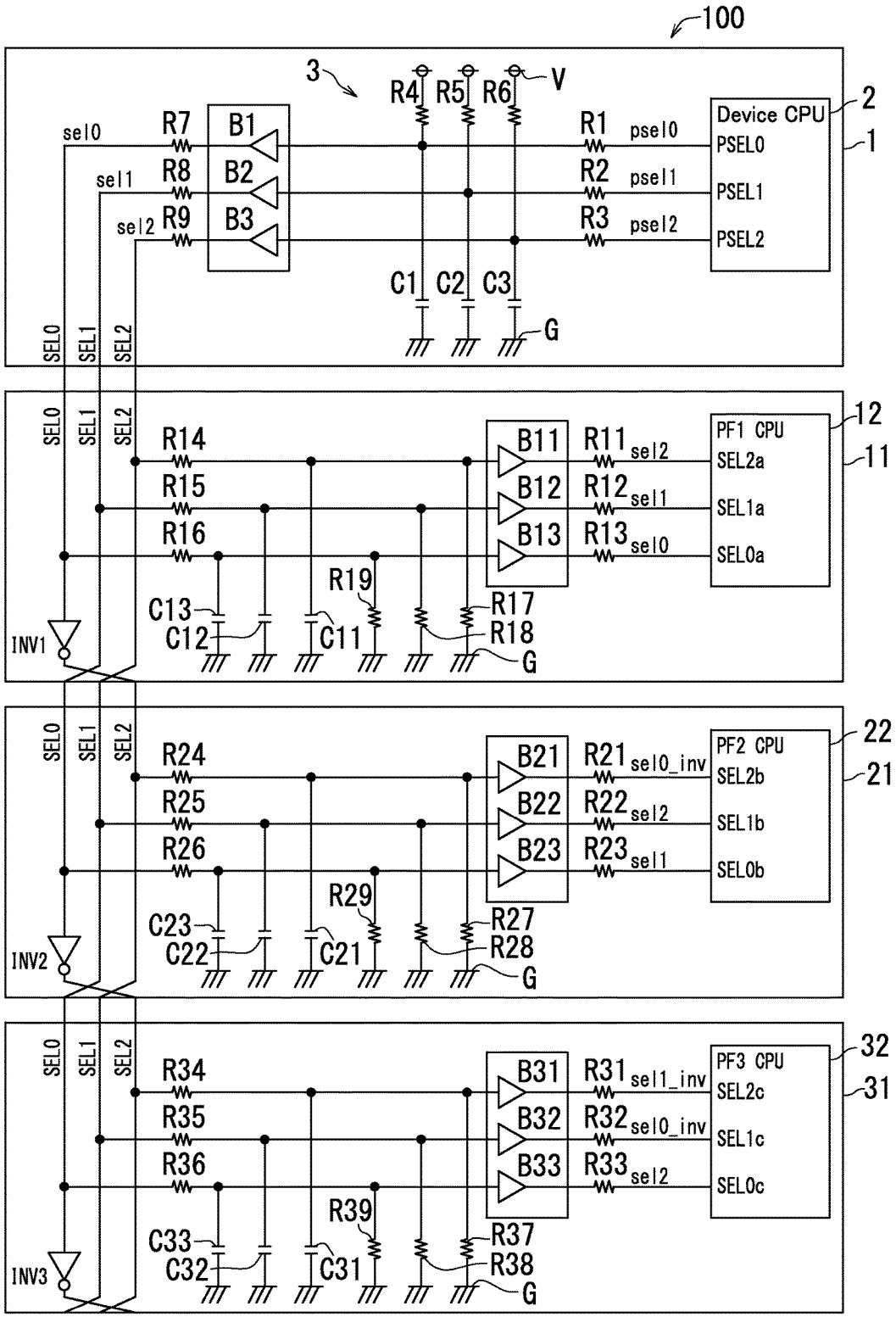
FIG. 5 is a circuit diagram of a paper feed device according to a third embodiment of the present disclosure.
Figure 7:
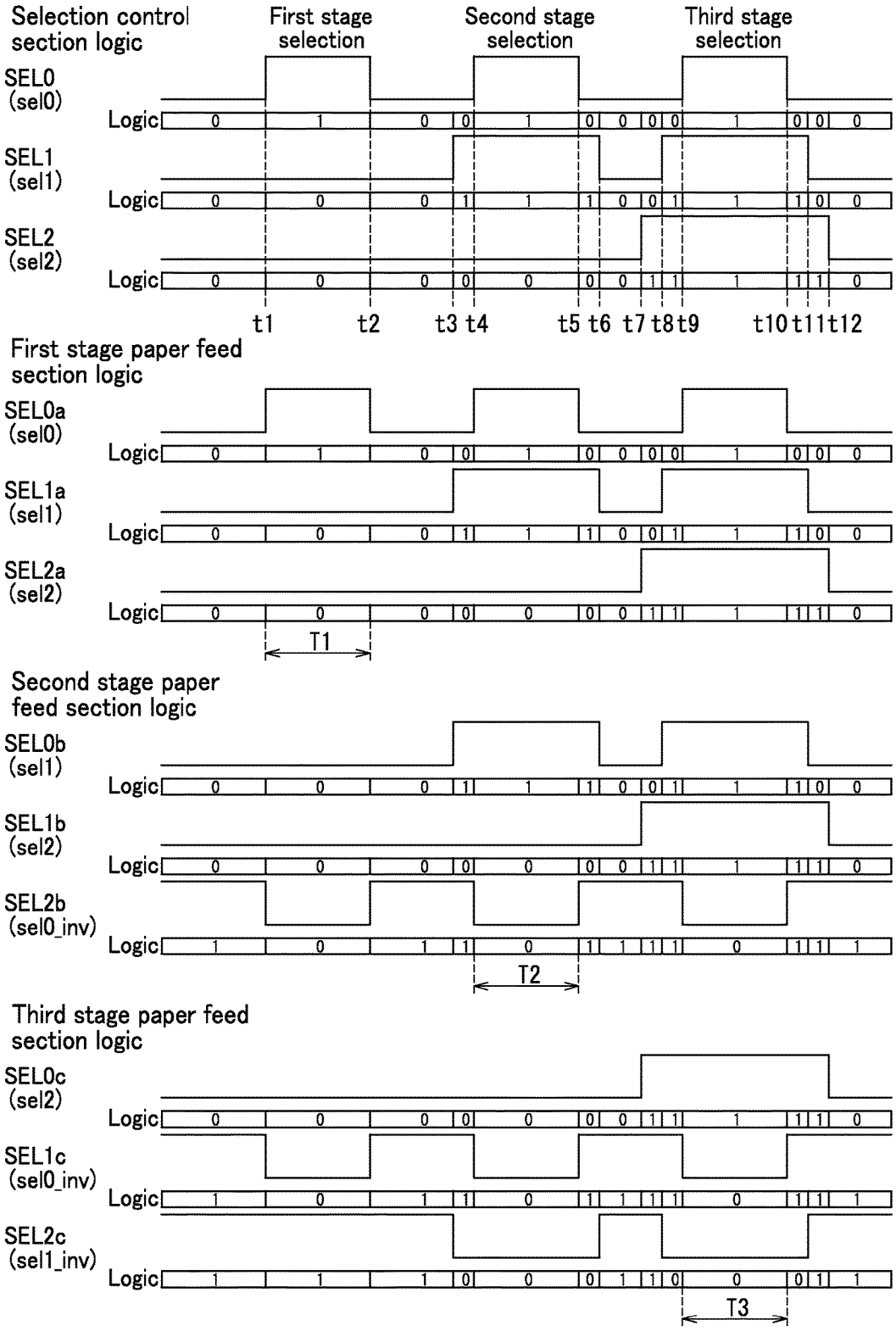
FIG. 7 is a time chart for the paper feed device according to the third embodiment of the present disclosure.

The following explains a paper feed device 100 according to a third embodiment of the present disclosure with reference to FIGS. 5-7. FIG. 5 is a circuit diagram of the paper feed device 100 according to the third embodiment of the present disclosure. FIG. 6 is a table illustrating selection logic of the paper feed device 100 according to the third embodiment of the present disclosure. FIG. 7 is a time chart for the paper feed device 100 according to the third embodiment of the present disclosure. Explanation is omitted for aspects of configuration that are the same as in the first embodiment and the second embodiment.

The paper feed device 100 includes paper feed sections (paper feed section 11, paper feed section 21, and paper feed section 31) and a selection control section 1. In the present embodiment the paper feed sections are present as three stages, with the paper feed section 11 corresponding to a first stage, the paper feed section 21 corresponding to a second stage, and the paper feed section 31 corresponding to a third stage.

The selection control section 1 further includes a power supply V in addition to a main control circuit 2 and a timing adjustment circuit 3. The main control section 2 (device CPU in FIG. 5) includes a first selection precursor terminal PSEL0, a second selection precursor terminal PSEL1, and a third selection precursor terminal PSEL2. The first selection precursor terminal PSEL0 outputs a selection precursor signal psel0. The second selection precursor terminal PSEL1 outputs a selection precursor signal psel1. The third selection precursor terminal PSEL2 outputs a selection precursor signal psel2.

The timing adjustment circuit 3 includes a first terminal resistance R1, a second terminal resistance R2, a third terminal resistance R3, a first power supply resistance R4, a second power supply resistance R5, a third power supply resistance R6, capacitors C1-C3, buffers B1-B3, and resistances R7-R9. The first terminal resistance R1, the buffer B1, and the resistance R7 are connected in series between the first selection precursor terminal PSEL0 of the main control section 2 and an output terminal SEL0 of the selection control section 1. In the same way, the second terminal resistance R2, the buffer B2, and the resistance R8 are connected in series between the second selection precursor terminal PSEL1 of the main control section 2 and an output terminal SEL1 of the selection control section 1. Furthermore, the third terminal resistance R3, the buffer B3, and the resistance R9 are connected in series between the third selection precursor terminal PSEL2 of the main control section 2 and an output terminal SEL2 of the selection control section 1.

The first terminal resistance R1 is connected to the first power supply resistance R4. The second terminal resistance R2 is connected to the second power supply resistance R5. The third terminal resistance R3 is connected to the third power supply resistance R6. The power supply V is connected, via the first power supply resistance R4, to a wire connecting the first terminal resistance R1 to the buffer B1. The power supply V is connected, via the second power supply resistance R5, to a wire connecting the second terminal resistance R2 to the buffer B2. The power supply V is connected, via the third power supply resistance R6, to a wire connecting the third terminal resistance R3 to the buffer B3. The wire connecting the first terminal resistance R1 to the buffer B1 is connected to ground G via the capacitor C1. The wire connecting the second terminal resistance R2 to the buffer B2 is connected to ground G via the capacitor C2. The wire connecting the third terminal resistance R3 to the buffer B3 is connected to ground G via the capacitor C3. The capacitors C1-C3 for example each have a capacitance of 1,000 pF. The resistances R7-R9 for example each have a resistance value of 0.1 kΩ.

The first terminal resistance R1, the second terminal resistance R2, and the third terminal resistance R3 have different resistance values relative to one another. The first terminal resistance R1, the second terminal resistance R2, and the third terminal resistance R3 are related to delay times of the fall of the selection signals sel0-sel2 relative to the selection precursor signals psel0-psel2. In the present embodiment, the first terminal resistance R1, the second terminal resistance R2, and the third terminal resistance R3 are in the stated order in terms of increasing magnitude of the resistance value thereof.

For example, the first terminal resistance R1 has a resistance value of 0.1 kΩ, the second terminal resistance R2 has a resistance value of 0.2 kΩ, and the third terminal resistance R3 has a resistance value of 0.3 kΩ. The selection signal sel0 has a fall time constant of 0.1 μs, the selection signal sel1 has a fall time constant of 0.2 μs, and the selection signal sel2 has a fall time constant of 0.3 μs. Therefore, in a situation in which the selection precursor signals psel0, psel1, and psel2 each fall at the same time, the selection signal sel0, the selection signal sel1, and the selection signal sel2 are in the stated order in terms of increasing delay of the fall time thereof.

The first power supply resistance R4, the second power supply resistance R5, and the third power supply resistance R6 have different resistance values relative to one another. The first power supply resistance R4, the second power supply resistance R5, and the third power supply resistance R6 are related to delay times of the rise of the selection signals sel0-sel2 relative to the selection precursor signals psel0-psel2. In the present embodiment, the first power supply resistance R4, the second power supply resistance R5, and the third power supply resistance R6 are in the stated order in terms of decreasing magnitude of the resistance value thereof.

For example, the first power supply resistance R4 has a resistance value of 1.2 kΩ, the second power supply resistance R5 has a resistance value of 1.1 kΩ, and the third power supply resistance R6 has a resistance value of 1 kΩ. The selection signal sel0 has a rise time constant of 1.2 μs, the selection signal sel1 has a rise time constant of 1.1 μs, and the selection signal sel2 has a rise time constant of 1.0 μs. Therefore, in a situation in which the selection precursor signals psel0, psel1, and psel2 each rise at the same time, the selection signal sel0, the selection signal sel1, and the selection signal sel2 are in the stated order in terms of progressively early rise time thereof.

The paper feed section 11 includes a paper feed control section 12 (PF1 CPU in FIG. 5), resistances R11-R13, capacitors C11-C13, buffers B11-B13, and resistances R14-R19. The paper feed section 11 has input terminals SEL0, SEL1, and SEL2. The resistance R16, the buffer B13, and the resistance R13 are connected in series between the input terminal SEL0 of the paper feed section 11 and an input terminal SEL0*a* of the paper feed control section 12. In the same way, the resistance R15, the buffer B12, and the resistance R12 are connected in series between the input terminal SEL1 of the paper feed section 11 and an input terminal SEL1*a* of the paper feed control section 12. The resistance R14, the buffer B11, and the resistance R11 are connected in series between the input terminal SEL2 of the paper feed section 11 and an input terminal SEL2*a* of the paper feed control section 12. A wire connecting the resistance R16 to the buffer B13 is connected to ground G via the resistance R19. A wire connecting the resistance R15 to the buffer B12 is connected to ground G via the resistance R18. A wire connecting the resistance R14 to the buffer B11 is connected to ground G via the resistance R17.

In addition, the wire connecting the resistance R16 to the buffer B13 is connected to ground G via the capacitor C13. The wire connecting the resistance R15 to the buffer B12 is connected to ground G via the capacitor C12. The wire connecting the resistance R14 to the buffer B11 is connected to ground G via the capacitor C11. An inverter INV1 is connected to the input terminal SEL0. The inverter INV1 inverts a signal input from the input terminal SEL0 and outputs the inverted signal.

The resistances R11-R13 each have the same resistance value as one another and the resistances R14-R19 each have the same resistance value as one another. For example, the resistances R11-R13 each have a resistance value of 1 kΩ and the resistances R14-R19 each have a resistance value of 0.1 kΩ. The capacitors C11-C13 each have the same capacitance as one another. For example, the capacitors C11-C13 each have a capacitance of 1,000 pF.

The paper feed section 21 and the paper feed section 31 each have the same configuration as the paper feed section 11. Therefore, explanation is omitted where appropriate to avoid repetition. Signals that are shifted by one position relative to an order of the selection signal sel0, the selection signal sel1, and the selection signal sel2 input to the paper feed section 11 are input to input terminals SEL0-SEL2 of the paper feed section 21. The signal input to the input terminal SEL2 is an inverted signal. More specifically, the selection signal sel0, the selection signal sel1, and the selection signal sel2 are respectively input to the input terminals SEL0, SEL1, and SEL2 of the paper feed section 11. In contrast, the selection signal sel1, the selection signal sel2, and an inverted signal sel0_inv of the selection signal sel0 are respectively input to the input terminals SEL0, SEL1, and SEL2 of the paper feed section 21. In the same way, the selection signal sel2, the inverted signal sel0_inv of the selection signal sel0, and an inverted signal sel1_inv of the selection signal sel1 are respectively input to input terminals SEL0, SEL1, and SEL2 of the paper feed section 31. Through the above configuration in which signal order is shifted by one position and inverted signals are input to paper feed sections, a paper feed section can be appropriately selected regardless of the number of stages of paper feed sections that are provided.

The following explains selection logic of the paper feed sections 11, 21, and 31 with reference to FIG. 6. The paper feed control sections 12, 22, and 32 are each designed in the same way. Upon any one of the paper feed control sections 12, 22, and 32 receiving a code "100", the paper feed control section 12, 22, or 32 recognizes selection thereof, becomes activated, and commences communication with the selection control section 1. The aforementioned code corresponds to the input terminals SEL0, SEL1, and SEL2 in order from left to right. In a situation in which the selection control section 1 outputs a code "100", the code "100" is input to the paper feed control section 12 of the first stage paper feed section 11 and, as a result, the first stage paper feed section 11 is selected. In a situation in which the first stage paper feed section 11 is selected, a code "000" is input to the paper feed control section 22 of the second stage paper feed section 21 and a code "001" is input to the paper feed control section 32 of the third stage paper feed section 31. As a result, the second stage paper feed section 21 and the third stage paper feed section 31 are not selected. In the same way, the second stage paper feed section 21 is selected in a situation in which the selection control section 1 outputs a code "110". Furthermore, the third stage paper feed section 31 is selected in a situation in which the selection control section 1 outputs a code "111". None of the paper feed sections 11, 21, and 31 are selected in a situation in which the selection control section 1 outputs a code other than "111", "110", or "100".

The following explains selection operation of the paper feed sections 11, 21, and 31 with reference to FIG. 7. During period T1 from time t1 to time t2, the selection control section 1 outputs a code "100" and, as a result, the first stage paper feed section 11 is selected due to the code "100" being input to the paper feed control section 12 of the first stage paper feed section 11.

During period T2 from time t4 to time t5, the selection control section 1 outputs a code "110" and, as a result, the second stage paper feed section 21 is selected due to a code "100" being input to the paper feed control section 22 of the second stage paper feed section 21. In a period between time t3 and time t4, before period T2, none of the paper feed sections 11, 21, and 31 are selected due to a code "100" not being input to any of the paper feed sections 11, 21, and 31. In a period from time t5 to time t6, after period T2, none of the paper feed sections 11, 21, and 31 are selected due to a code "100" not being input to any of the paper feed sections 11, 21, and 31. As described above, both before and after selection of the second stage paper feed section 21, the selection signals sel0, sel1, and sel2 are switched such that none of the paper feed sections 11, 21, and 31 are selected.

During period T3 from time t9 to time t10, the selection control section 1 outputs a code "111" and, as a result, the third stage paper feed section 31 is selected due to a code "100" being input to the paper feed control section 32 of the third stage paper feed section 31. During a period from time t7 to time t8 and a period from time t8 to time t9, before period T3, none of the paper feed sections 11, 21, and 31 are selected due to a code "100" not being input to any of the paper feed sections 11, 21, and 31. In addition, during a period from time t10 to time t11 and a period from time t11 to time t12, after period T3, none of the paper feed sections 11, 21, and 31 are selected due to a code "100" not being input to any of the paper feed sections 11, 21, and 31. As described above, both before and after selection of the third stage paper feed section 31, the selection signals sel0, sel1, and sel2 are switched such that none of the paper feed sections 11, 21, and 31 are selected.

As explained above with reference to FIGS. 5-7, the first terminal resistance R1 and the second terminal resistance R2 have different resistance values relative to one another and the first power supply resistance R4 and the second power supply resistance R5 have different resistance values relative to one another in the timing adjustment circuit 3. Therefore, even if there is a deviation in timing due to a delay in selection signal propagation, a paper feed section can be appropriately selected by intentionally adjusting times at which the selection signal sel0 and the selection signal sel1 are switched.

In addition, the first terminal resistance R1 has a larger resistance value than the second terminal resistance R2 and the first power supply resistance R4 has a smaller resistance value than the second power supply resistance R5. Therefore, the selection signal sel1 is switched to the selection level (HIGH) before the selection signal sel0 is switched to the selection level and is switched to the normal level (LOW) after the selection signal sel0 has been switched to the normal level.

[Fourth Embodiment]

Figure 8:
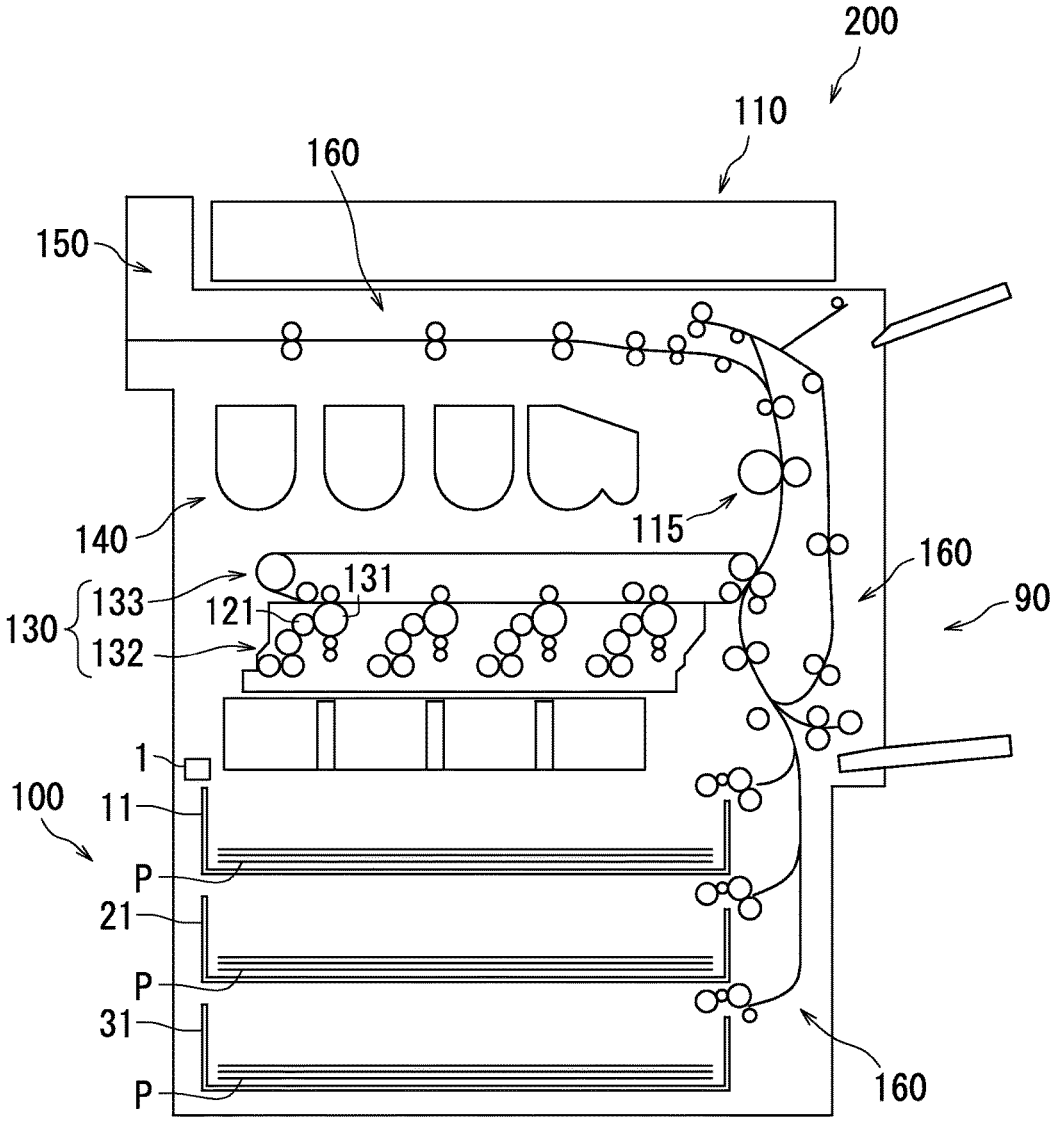
FIG. 8 is a schematic diagram illustrating an image forming apparatus according to a fourth embodiment of the present disclosure.

FIG. 8 is a schematic diagram illustrating an image forming apparatus 200 according to a fourth embodiment of the present disclosure. The image forming apparatus 200 can be a copier, a printer, a facsimile machine, or a multifunction peripheral that functions as a combination of the aforementioned machines. The following explains the present disclosure for an example in which the image forming apparatus 200 is a copier, but the present disclosure is not limited to such a configuration. The image forming apparatus 200 includes a paper feed device 100, an image scanning section 110, and an image forming section 90. The image forming section 90 includes a fixing device 115, an imaging section 130, a toner replenishment device 140, a paper ejecting section 150, and a paper conveyance section 160. The image forming section 90 forms an image on paper fed by the paper feed device 100 based on image data acquired through scanning by the image scanning section 110.

Printing paper P is loaded into a paper feed section 11, a paper feed section 21, and a paper feed section 31. When copying is to be performed, one of the paper feed sections 11, 21, and 31 is selected based, for example, on a paper size selected by a user through an operation section. Paper P loaded in the selected paper feed section is conveyed by the paper conveyance section 160 such as to pass through the imaging section 130 and the fixing device 115 before being ejected from the paper ejecting section 150.

The imaging section 130 forms a toner image on the paper P. The imaging section 130 includes a photosensitive member 131, a developing device 132, and a transfer device 133.

The photosensitive member 131 forms an electrostatic latent image using a laser based on an electronic signal of a document image generated by the image scanning section 110. The developing device 132 includes a development roller 121. The development roller 121 supplies toner to the photosensitive member 131 and thereby develops the electrostatic latent image to form a toner image on the photosensitive member. Toner in the developing device 132 is replenished by toner from the toner replenishment device 140.

The transfer device 133 transfers the toner image from the photosensitive member 131 to the paper P.

The fixing device 115 applies heat and pressure to the paper P and thereby causes melting and fixing to the paper P of unfixed toner that has been transferred onto the paper P in the imaging section 130.

Through the above, embodiments of the present disclosure have been described with reference to the drawings (FIGS. 1-8). However, the present disclosure is of course not limited to the above embodiments and may be practiced in various forms without deviating from the essence thereof (for example, as explained below in sections (1) and (2)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as material properties, shapes, and dimensions, are merely examples and are not intended as specific limitations. Various alterations may be made so long as there in no substantial deviation from the effects of the present disclosure.

(1) Although the paper feed devices 10 according to the first and second embodiments each include two paper feed sections and the paper feed device 10 according to the third embodiment includes three paper feed sections, the present disclosure is not limited to such configurations. For example, alternatively four or more paper feed sections may be provided.

(2) Although the normal level is LOW and the selection level is HIGH in the paper feed devices 10 according to the first, second, and third embodiments, the present disclosure is not limited to such a configuration. For example, in an alternative configuration the normal level may be HIGH and the selection level may be LOW.

What is claimed is:

1. A paper feed device comprising:

a plurality of paper feed sections each including a paper feed control section; and a selection control section configured to output a plurality of selection signals to each of the plurality of paper feed sections for selecting a paper feed section from among the plurality of paper feed sections, wherein each of the paper feed control sections is configured to commence communication with the selection control section based on the plurality of selection signals, each of the plurality of selection signals is switchable between a normal level and a selection level, the plurality of selection signals are set such as to select a paper feed section from among the plurality of paper feed sections during selection periods and to not select any of the paper feed sections during non-selection periods, the selection periods include a specific selection period during which at least two selection signals among the plurality of selection signals are at the selection level, the non-selection periods include:

a first normal period during which each of the plurality of selection signals is at the normal level;

a second normal period during which each of the plurality of selection signals is at the normal level;

a preceding non-selection period during which a specific selection signal among the at least two selection signals is switched from the normal level to the selection level; and a succeeding non-selection period during which the specific selection signal is switched from the selection level to the normal level, the preceding non-selection period consecutively follows the first normal period, the specific selection period consecutively follows the preceding non-selection period, the succeeding non-selection period consecutively follows the specific selection period, the second normal period consecutively follows the succeeding non-selection period, and in a situation in which the selection control section switches the at least two selection signals from the normal level to the selection level, the selection control section switches the specific selection signal from the normal level to the selection level before switching another selection signal among the at least two selection signals from the normal level to the selection level.

2. The paper feed device according to claim 1, wherein the selection control section includes:

a main control section configured to output a plurality of selection precursor signals; and a timing adjustment circuit configured to generate the plurality of selection signals based on the plurality of selection precursor signals, and the timing adjustment circuit generates the plurality of selection signals from the plurality of selection precursor signals by delaying the plurality of selection precursor signals by different periods of time relative to one another.

3. The paper feed device according to claim 2, wherein the selection control section further includes a power supply, the main control section has a first selection precursor terminal and a second selection precursor terminal, the timing adjustment circuit includes:

a first terminal resistance connected to the first selection precursor terminal;

a second terminal resistance connected to the second selection precursor terminal;

a first power supply resistance connected to the power supply; and a second power supply resistance connected to the power supply, the first terminal resistance is connected to the first power supply resistance, the second terminal resistance is connected to the second power supply resistance, the first terminal resistance has a different resistance value to the second terminal resistance, and the first power supply resistance has a different resistance value to the second power supply resistance.

4. The paper feed device according to claim 3, wherein the first terminal resistance has a larger resistance value than the second terminal resistance and the first power supply resistance has a smaller resistance value than the second power supply resistance.

5. An image forming apparatus comprising:

the paper feed device according to claim 1; and an image forming section configured to form an image on paper fed from the paper feed device.

6. A paper feed device comprising:

a plurality of paper feed sections each including a paper feed control section; and a selection control section configured to output a plurality of selection signals to each of the plurality of paper feed sections for selecting a paper feed section from among the plurality of paper feed sections, wherein each of the paper feed control sections is configured to commence communication with the selection control section based on the plurality of selection signals, each of the plurality of selection signals is switchable between a normal level and a selection level, the plurality of selection signals are set such as to select a paper feed section from among the plurality of paper feed sections during selection periods and to not select any of the paper feed sections during non-selection periods, the selection periods include a specific selection period during which at least two selection signals among the plurality of selection signals are at the selection level, the non-selection periods include:

a first normal period during which each of the plurality of selection signals is at the normal level;

a second normal period during which each of the plurality of selection signals is at the normal level;

a preceding non-selection period during which a specific selection signal among the at least two selection signals is switched from the normal level to the selection level; and a succeeding non-selection period during which the specific selection signal is switched from the selection level to the normal level, the preceding non-selection period consecutively follows the first normal period, the specific selection period consecutively follows the preceding non-selection period, the succeeding non-selection period consecutively follows the specific selection period, the second normal period consecutively follows the succeeding non-selection period, and in a situation in which the selection control section switches the at least two selection signals from the selection level to the normal level, the selection control section switches the specific selection signal from the selection level to the normal level after switching another selection signal among the at least two selection signals from the selection level to the normal level.

7. An image forming apparatus comprising:

the paper feed device according to claim 6, and an image forming section configured to form an image on paper fed from the paper feed device.

* * * * *